US010718180B2

(12) United States Patent
Andrigo

(10) Patent No.: US 10,718,180 B2
(45) Date of Patent: Jul. 21, 2020

(54) WELLBORE SEALING SYSTEMS AND METHODS

(71) Applicant: TOP-CO INC., Houston, TX (US)

(72) Inventor: Gregory James Alexander Andrigo, Almonte (CA)

(73) Assignee: TOP-CO INC., Houston, TX (US)

( * ) Notice: Subject to any disclaimer, the term of this patent is extended or adjusted under 35 U.S.C. 154(b) by 693 days.

(21) Appl. No.: 14/694,299

(22) Filed: Apr. 23, 2015

(65) Prior Publication Data

US 2016/0312566 A1 Oct. 27, 2016

Related U.S. Application Data

(60) Provisional application No. 61/984,548, filed on Apr. 25, 2014.

(51) Int. Cl.
*E21B 33/16* (2006.01)
*E21B 21/10* (2006.01)

(52) U.S. Cl.
CPC ..... *E21B 33/16* (2013.01); *E21B 21/10* (2013.01)

(58) Field of Classification Search
CPC ..... E21B 33/05; E21B 33/10; E21B 33/12; E21B 33/13; E21B 33/14; E21B 33/16; E21B 34/06
See application file for complete search history.

(56) References Cited

U.S. PATENT DOCUMENTS 4,624,312 A 11/1986 McMullin
5,095,980 A * 3/1992 Watson ..... E21B 29/00 166/153
5,234,052 A * 8/1993 Coone ..... E21B 33/16 166/155
5,813,457 A 9/1998 Giroux et al.
6,082,451 A * 7/2000 Giroux ..... E21B 21/10 166/153
7,703,523 B2 * 4/2010 Wardley ..... E21B 33/16 166/177.3
8,201,634 B2 * 6/2012 Laurel ..... E21B 33/16 166/153
2007/0102159 A1 * 5/2007 Szarka ..... E21B 33/16 166/291
2008/0128140 A1 6/2008 Giroux et al.
2009/0250217 A1 * 10/2009 Webb ..... E21B 33/16 166/285
2010/0294503 A1 * 11/2010 Laurel ..... E21B 33/16 166/335
2014/0338925 A1 * 11/2014 Warlick ..... E21B 33/13 166/387

(Continued)

OTHER PUBLICATIONS

United States International Searching Authority; International Search Report & Written Opinion for PCT/US2015/027446; dated Jul. 20, 2015; 10 pages; Alexandria, VA; US.

*Primary Examiner* — James G Sayre

(74) *Attorney, Agent, or Firm* — Pillsbury Winthrop Shaw Pittman LLP

(57) ABSTRACT

A wellbore sealing system includes a dart retained in a top plug and deployable through a bore defined in the top plug and through a bore defined in the bottom plug to sealingly engage float equipment abutting the bottom plug. The dart and float equipment bear wellbore pressure directly. The dart latches with the float equipment and sealing features provide bi-directional sealing.

4 Claims, 9 Drawing Sheets

(56) References Cited

U.S. PATENT DOCUMENTS

| | | | | |
|---|---|---|---|---|
| 2015/0101801 | A1* | 4/2015 | Budde | E21B 33/14<br>166/250.01 |
| 2016/0281442 | A1* | 9/2016 | Stokes | E21B 23/00 |

* cited by examiner

WELLBORE SEALING SYSTEMS AND METHODS

CROSS-REFERENCE TO RELATED APPLICATIONS

This application claims priority to provisional application Ser. No. 61/984,548, filed Apr. 25, 2014, and titled Wellbore Sealing System and Methods, which is incorporated herein in its entirety by reference.

FIELD OF INVENTION

This invention generally relates to wellbore cementing equipment, and in particular to plug and dart systems deployable as high-pressure fluid barriers in wellbore cementing processes.

BACKGROUND OF THE INVENTION

Plug and dart system are commonly used as fluid barriers during wellbore cementing processes. Typically, top and bottom plugs are deployed respectively before and after pumping of cement to isolate the cement slurry from other working fluids. Many of these cementing processes rely on pressure thresholds to initiate or finalize various process steps, e.g., launching of the bottom plug, landing of the bottom plug on float equipment, rupture of a bottom plug fluid bather, launching of the top plug, landing of the top plug on the bottom plug, and seating of a sealing member. Differential pressures during subsequent pressure checks and operations can potentially compromise the integrity of the plug system. Accordingly, improvements are sought in high-pressure plug systems for wellbore casing cementing operations.

SUMMARY OF THE INVENTION

In general, the present invention provides a top plug with a sealing or shut-off dart secured therein by a shear ring, the sealing dart being deployable from the plug to form a high-pressure seal directly with the float equipment following shearing of the shear ring. Thus, subsequent high-pressure differentials are borne by the sealing dart and float equipment, obviating problems associated with over-pressurization of conventional plug sealing systems.

One aspect of the invention features, in some embodiments, a plug system including top and bottom plugs and respective release and launching mechanisms. In some embodiments, the top and bottom plugs include substantially rigid cores defining axial bores therethrough. The bores accommodate pressure-activated plug launching mechanisms and/or selective passage of working fluids. A sealing dart is retained within the axial bore of the top plug. A shear ring is disposed between shear features defined on the sealing dart and within the axial bore to allow for selective release of the sealing dart from within the top plug.

In use, the top plug is displaced down the wellbore to ultimately land on the bottom plug to conclude a cement slurry pumping operation. Subsequent pressurization and differential pressure across the top plug causes shearing of the shear ring within the top plug and further displacement of the sealing dart through the axial bore defined in the top and bottom plugs and into sealing engagement with a receptacle or seat defined by the float equipment.

In some embodiments, the receptacle is defined within a float collar.

In some embodiments, the receptacle is disposed adjacent the float valve.

In some embodiments, the receptacle is defined within a landing collar, float shoe, guide shoe, stage collar, fracking collar, or any other type of downhole equipment. In some embodiments, the receptacle is cemented in place within the respective downhole equipment. In some embodiments, the receptacle is threaded into a casing or other downhole equipment or is made integral with the downhole equipment, e.g., integral with a float valve. In some embodiments, integral construction may be desirable for higher-pressure applications, e.g., higher fracking pressures, greater range of deployment, and higher-pressure casing testing.

In some embodiments, one size of modular sealing dart and receptacle can be used across a broad range of plug system sizes.

In some embodiments, receipt of the sealing dart within the receptacle defined by the float equipment provides bi-directional sealing. In some embodiments, the sealing dart includes a latch feature to lockingly engage with a complementary feature of the float equipment, e.g., a shoulder or recess.

In some embodiments, the latch feature includes locking lugs receivable within an annular recess defined within the receptacle of the float equipment.

In some embodiments, the latch feature is spring loaded, e.g., a spring-loaded lock dog.

In some embodiments, the latch feature defines a tapered leading edge and a stepped trailing edge to provide one-way locking engagement with the float equipment.

In some embodiments, the latch feature defines a segmented circumferential ring about the sealing dart. Gaps between latch segments allow for inward compression of latch segments as the latch passes through the receptacle and outward spring-loaded expansion as it passes complementary receptacle latch features.

In some embodiments the latch feature includes a ratcheting feature, threads, snap ring, or other retention mechanism.

In some embodiments, the sealing dart defines a section of circumferential V-packing. The V-packing provides a high-pressure bi-directional seal with the axial bore. In some embodiments elastomeric seals such as O-rings or face sealing gaskets can provide high-pressure bi-directional seals.

In some embodiments, a primary seal is formed between the sealing dart and the axial bore. In some cases the sealing dart nose forms a secondary seal with the receptacle. In some embodiments, the sealing dart bears O-rings, V-packing, or other elastomeric seal to maintain sealing engagement with the axial bores of the plugs during displacement therethrough. Such sealing surfaces may be overmolded onto the sealing dart or may be otherwise formed or assembled thereon.

In some embodiments, a portion of the sealing dart further sealingly engages the bottom plug when seated in the float equipment.

In some embodiments, the sealing dart includes a lower sealing feature for engaging the float equipment and an upper sealing feature for engaging the axial bore of the bottom plug.

In some embodiments the sealing feature for the axial bore of the float equipment receptacle can be located below the latch feature as opposed to above it as shown in the drawings. The latch can be moved above the V-packing or O-ring.

In some embodiments, the tapered tip or nose of the dart which bottoms on the receptacle prevents it from passing through the receptacle. In some cases, the nose bottoms out on a shoulder formed in the receptacle.

In some embodiments, the plug system includes anti-rotation features to minimize plug rotation during plug drillout. Such anti-rotation features can resist rotation between the bottom plug and float equipment or between the top and bottom plug. The sealing dart may also include an anti-rotation feature between the dart and the receptacle.

In some embodiments, the float equipment defines at least one of a sealing dart receptacle and a sealing dart seat configured to sealingly engage the sealing dart.

In some embodiments, the float equipment includes a receptacle to receive the sealing dart. In some embodiments, the receptacle includes opposed sealing surfaces to provide bi-directional sealing engagement with the sealing dart.

Another aspect of the invention features a method of sealing a wellbore following a cementing operation. In some applications, the method includes deploying a top plug bearing a sealing dart down the wellbore as a barrier between a cement slurry flow and a trailing working fluid. The method further includes landing the top plug on a bottom plug previously deployed ahead of the cement slurry flow. The method further includes pressurizing the wellbore to shear a shear feature securing the sealing dart within the top plug. The method further includes displacing the sealing dart through an axial bore defined by the bottom dart and into sealing engagement with a sealing seat defined by the float equipment.

In some applications, the method further includes latching the sealing dart to the float equipment to provide bi-directional fluid flow resistance.

In some applications, subsequent high pressures within the wellbore are substantially maintained by sealing engagement of the sealing dart and the float equipment.

In some applications, the top and bottom plug do not substantially contribute to the maintenance of subsequent high pressures within the wellbore.

In some applications, the method further includes provision of a tapered interface between the dart nose and the retention ring that acts to tighten the latch when an upward pressure is applied. In some cases, a tapered or cammed interface between latch segments and the sealing dart body increase outward pressure on the latch segments in proportion to upward pressure applied to the sealing dart. This effectively locks the sealing dart within the receptacle once latched into place even when subjected to high pressures or to bottom pressures.

BRIEF DESCRIPTION OF THE DRAWINGS

A more complete understanding of the present invention may be derived by referring to the detailed description and claims when considered in connection with the Figures, wherein like reference numerals refer to similar elements throughout the Figures.

DETAILED DESCRIPTION

Figure 1A:
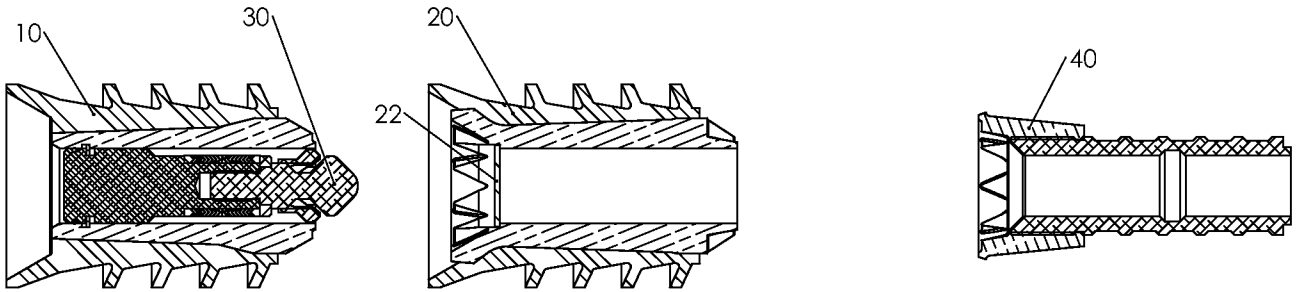
FIGS. 1*a-e* illustrate cross-sectional views of various stages of deployment of the top and bottom plug and sealing dart according to one embodiment.

The following description is of exemplary embodiments of the invention only, and is not intended to limit the scope, applicability or configuration of the invention. Rather, the following description is intended to provide a convenient illustration for implementing various embodiments of the invention. As will become apparent, various changes may be made in the function and arrangement of the elements described in these embodiments without departing from the scope of the invention as set forth herein. It should be appreciated that the description herein may be adapted to be employed with alternatively configured devices having different shapes, components, mechanisms and the like and still fall within the scope of the present invention. Thus, the detailed description herein is presented for purposes of illustration only and not of limitation.

Reference in the specification to "one embodiment" or "an embodiment" is intended to indicate that a particular feature, structure, or characteristic described in connection with the embodiment is included in at least an embodiment of the invention. The appearances of the phrase "in one embodiment" or "an embodiment" in various places in the specification are not necessarily all referring to the same embodiment.

FIGS. 1-5 illustrate different views of a plug and dart system. In general, a bottom plug 20 and top plug 10 are independently deployed down a wellbore as fluid bathers bounding a cement slurry flow pumped down the wellbore. Bottom plug 20 leads the cement slurry and lands on the float equipment, e.g., float collar, with further pressurization rupturing a fluid barrier 22 of bottom plug 20 to allow passage of the cement slurry through bottom plug 20 and float equipment. Top plug 10 is deployed trailing the cement slurry and wiping the slurry from the sidewalls until top plug 10 lands on bottom plug 20. After top plug 10 lands on bottom plug 20, and differential pressure is applied to release sealing dart 30. Sealing dart 30 may be released by shearing of a shear ring 32 or by other release mechanism. Further pressurization dislodges sealing dart 30 from within top plug 10 to pass through a bore defined in bottom plug 20 and into a sealing dart receptacle 40 within the float equipment. While the present invention is described herein in the exemplary context of wellbore cementing processes, aspects of the present invention may be employed in any number of other wellbore operations.

Figure 1B:
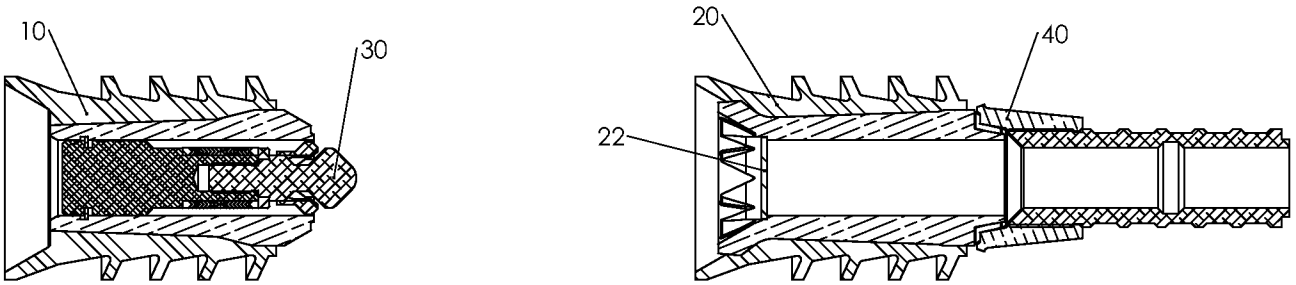
Figure 1C:
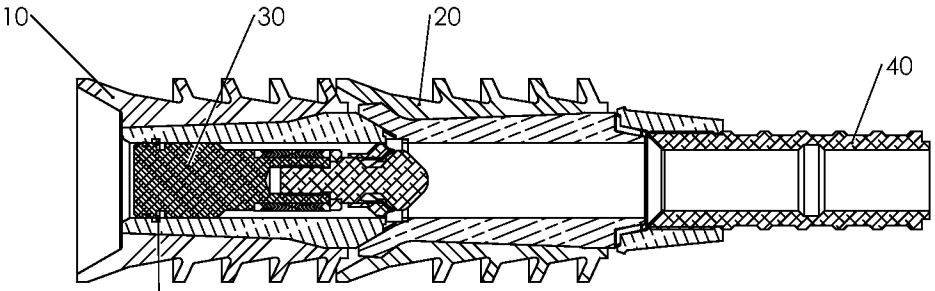
Figure 1D:
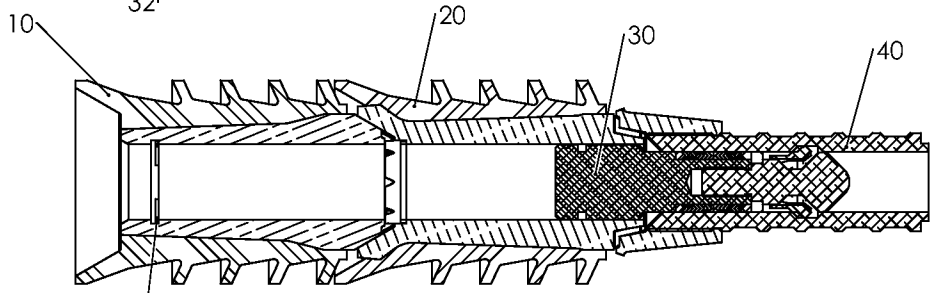
Figure 1E:
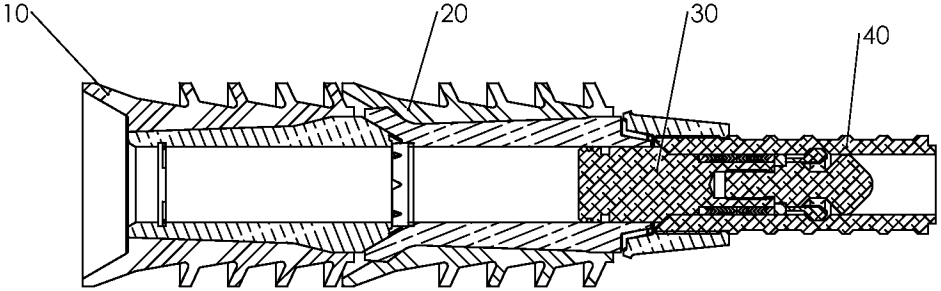

With reference now to FIGS. 1*a-e*, various stages of deployment of a top plug 10, bottom plug 20 and sealing dart 30 are shown according to one embodiment. FIG. 1*a* shows top plug 10 and integral sealing dart 30 separate from bottom plug 20 and receptacle 40. FIG. 1*b* shows bottom plug 20 landed atop receptacle 40, which receptacle is later depicted housed within a float collar. FIG. 1*c* shows top plug 10 with integral sealing dart 30 landed on or bumped with bottom plug 20 following pumping of cement. FIG. 1*d* shows sealing dart 30 dislodged from top plug 10 by further pressurization and passing through the bore defined in bottom plug 20 towards receptacle 40. FIG. 1*e* shows sealing dart 30 received and latched within receptacle 40 to form a seal directly with receptacle 40 within the float equipment. While upper end of sealing dart 30 is depicted as having contact with bottom plug 20 in the latched position, other embodiments may receive sealing dart 30 fully within receptacle 40. Thus, sealing dart 30 may be received entirely within the float equipment, substantially within a receptacle within the float equipment, or only a primary sealing portion of the sealing dart may be received within the receptacle within the float equipment.

Figure 2A:
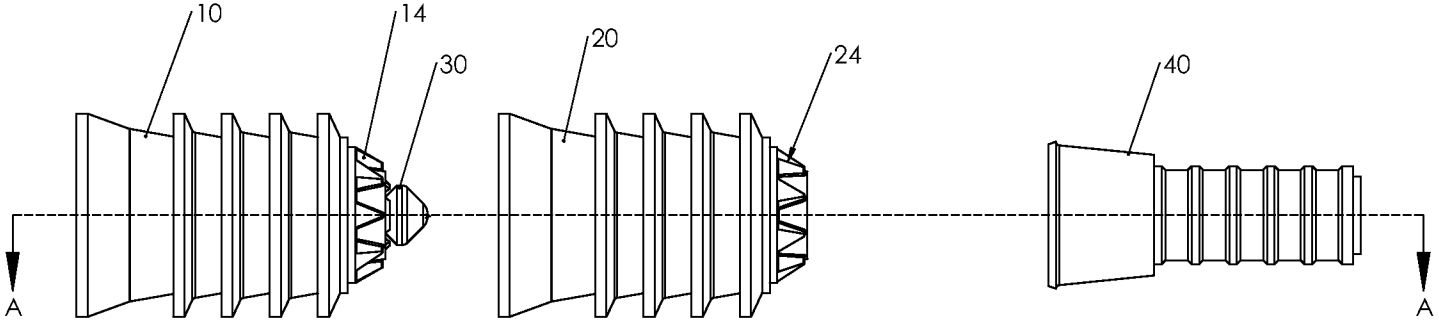
FIG. 2*a* illustrates a side view of a plug and dart system according to one embodiment, including a sealing dart secured within the top plug and a bottom plug and a sealing dart receptacle configured for receipt of the sealing dart deployable from the top plug.
Figure 2B:
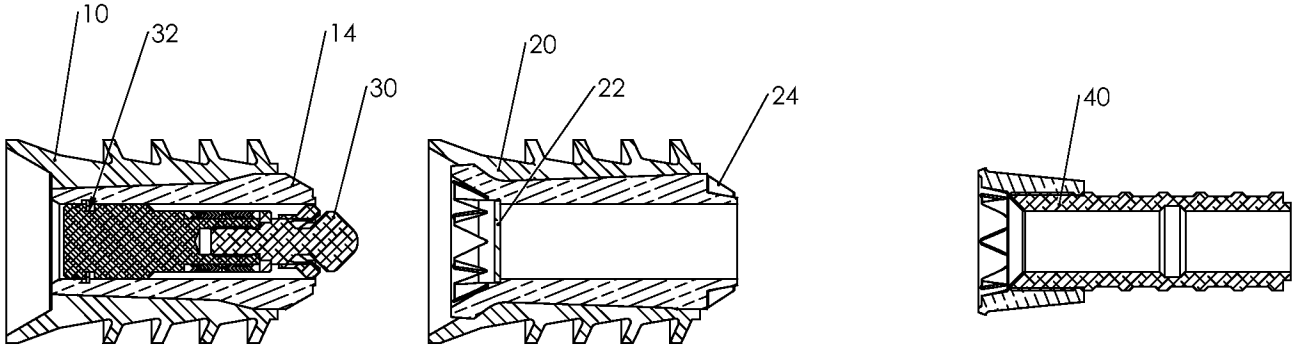
FIG. 2*b* illustrates a cross-sectional view of the plug and dart system of FIG. 2*a;*
Figure 2C:
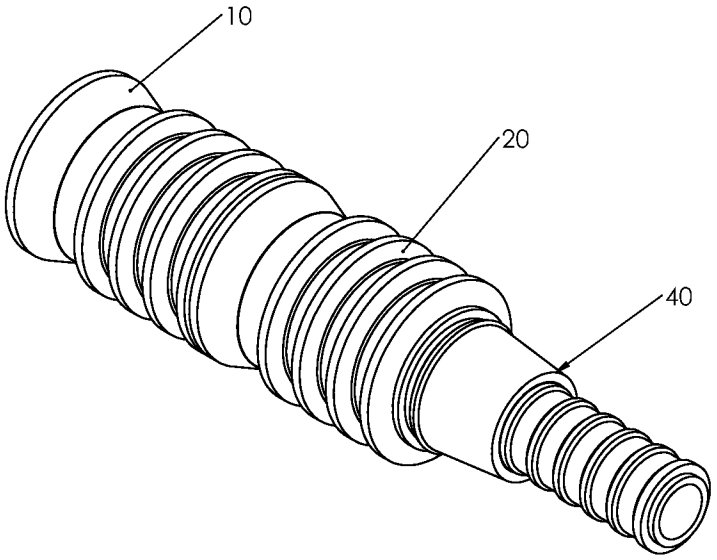
FIG. 2*c* illustrates a perspective view of the combined plug and dart system following landing of the bottom and top plugs on the float collar.

With reference now to FIGS. 2*a-c*, the plug and dart system are depicted, including bottom plug 20, sealing dart 30 secured within top plug 10, and sealing dart receptacle 40 and a float valve housed within a float collar. Anti-rotation features 14 and 24 engage complementary features when plugs 10 and 20 are landed to prevent rotation during subsequent drill-out. FIG. 2*c* shows plugs 10, 20 and receptacle 40 in stacked relation following landing of bottom plug 20 and top plug 10. FIG. 2*b* is a cross-sectional view along line A-A of FIG. 2*a* and shows sealing dart 30 secured within top plug 10 via shear ring 32.

Figure 3A:
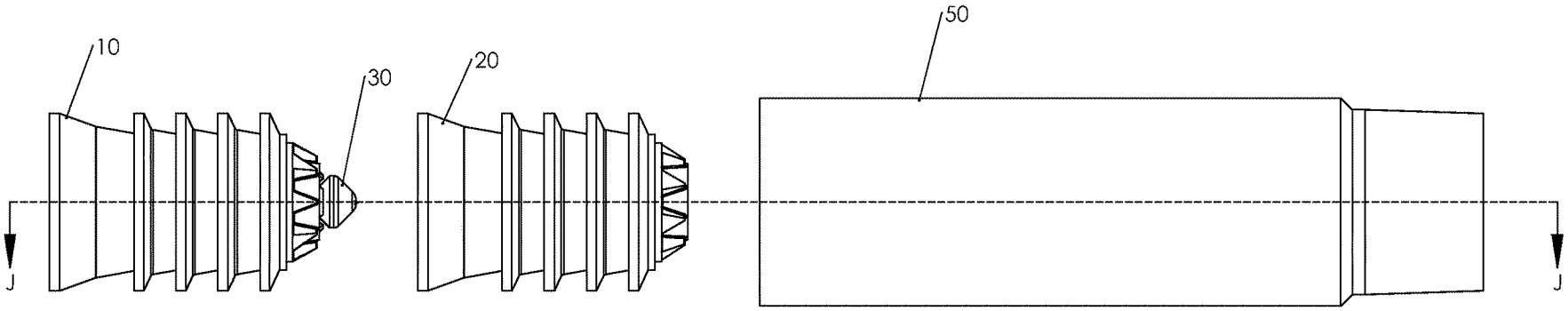
FIG. 3*a* illustrates a side view of the plug and dart system of FIGS. 2*a-c*, including a sealing dart secured within the top plug, a bottom plug and float collar housing the sealing dart receptacle.
Figure 3B:
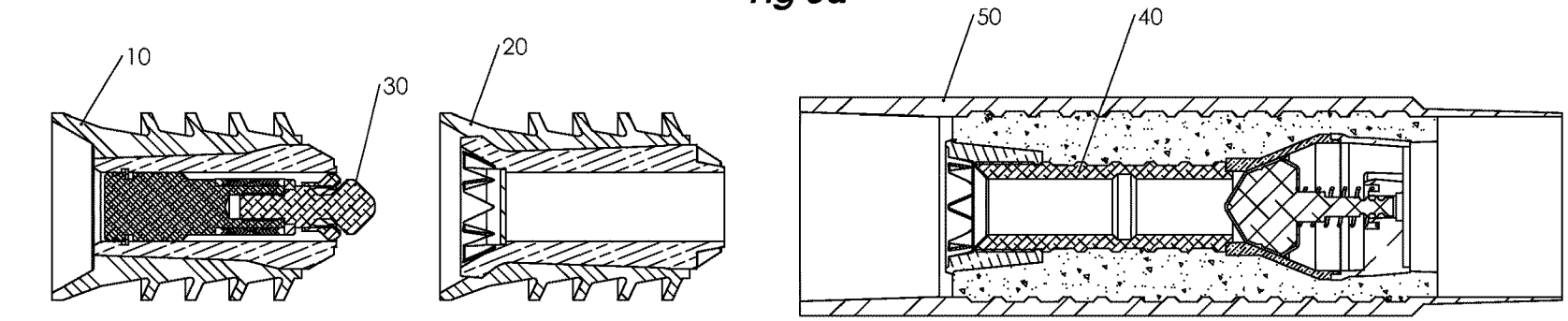
FIG. 3*b* illustrates a cross-sectional view of the plug and dart system of FIG. 3*a* showing the sealing dart receptacle disposed within the float collar.
Figure 4A:
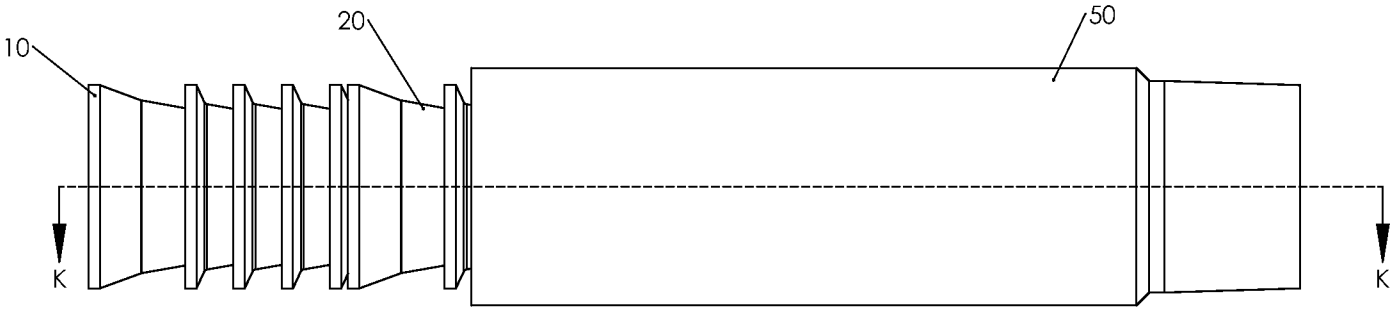
FIG. 4*a* illustrates a side view of the combined plug and dart system of FIGS. 3*a-b* following landing of the bottom and top plugs on the float collar.
Figure 4B:
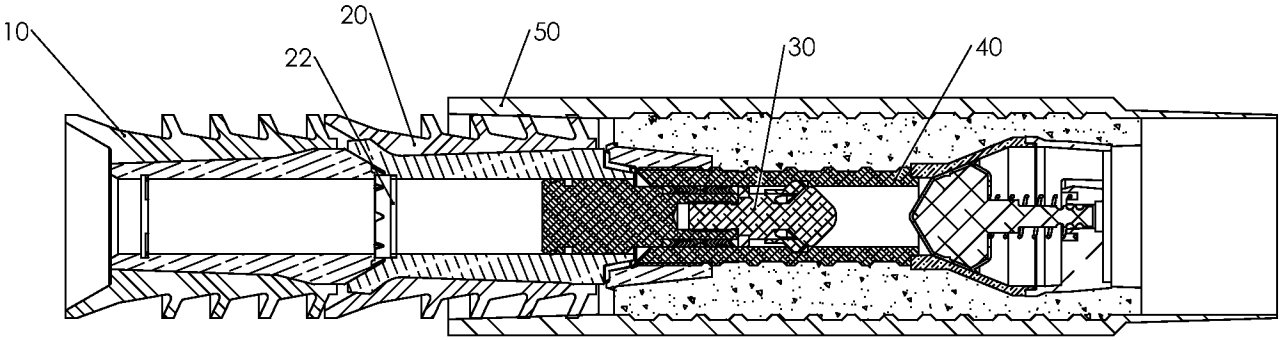
FIG. 4*b* illustrates a cross-sectional view of the plug and dart system of FIG. 4*a* showing the sealing dart seated in the receptacle disposed within the float collar.

With reference now to FIGS. 3*a-b*, another embodiment is shown in which receptacle 40 is positioned adjacent a float valve within a float collar 50. With reference now to FIGS. 4*a-b*, the combined plug and dart system of FIGS. 3*a-b* is depicted following landing of bottom and top plugs 10, 20 on the float collar 50 and receipt of sealing dart 30 in receptacle 40 within the float equipment.

Figure 5A:
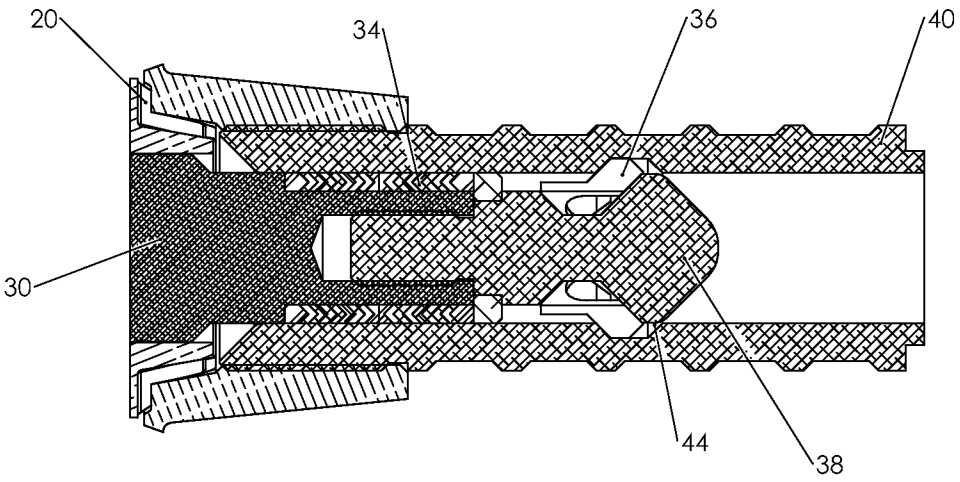
FIG. 5*a* illustrates a cross-sectional view of the sealing dart latched in the float equipment to maintain bottom pressure according to one embodiment.
Figure 5B:
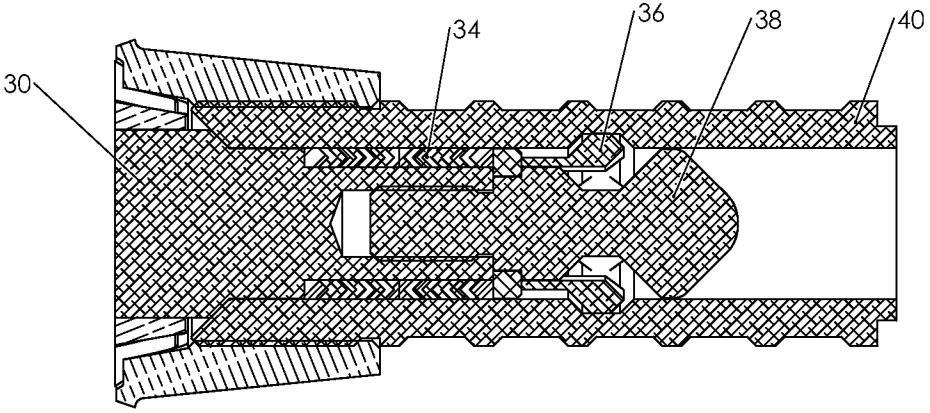
FIG. 5*b* illustrates a cross-sectional view of the sealing dart latched in the float equipment to maintain top pressure according to one embodiment.

With reference to FIGS. 5*a-b*, different sealing surfaces of sealing dart 30 can engage complementary surfaces within receptacle 40 under top pressure or bottom pressure. With reference to FIG. 5*a*, sealing dart 30 is shown latched in receptacle 40 to maintain top pressure according to one embodiment. With reference to FIG. 5*b*, sealing dart 30 is shown latched in receptacle 40 to maintain bottom pressure according to one embodiment. Thus, sealing dart 30 can hold both top and bottom pressure directly in sealing contact with the float equipment rather than holding top pressure solely across the bottom plug or bottom pressure solely across the float valve as in conventional designs.

With continued reference to FIG. 5*a*, one embodiment of sealing dart 30 is depicted as landed, latched and sealed within dart receptacle 40. A series of V-packings 34 formed on the exterior of sealing dart 30 engage the interior walls of the receptacle to form a high-pressure, bi-directional axial seal. A compression ring latch 36 is biased into engagement with a recess formed within receptacle 40. Compression ring latch 36 can be biased outward by a spring and can be further forced outward by a tapered or cammed surface spreading the compression ring diametrically in the event of application of upward forces on sealing dart 30, e.g., in the event of bottom pressures through the float valve. The nose 38 of sealing dart 30 can form a secondary seal with a shoulder 44 defined within receptacle 40 during application of downward pressures.

Figure 6C:
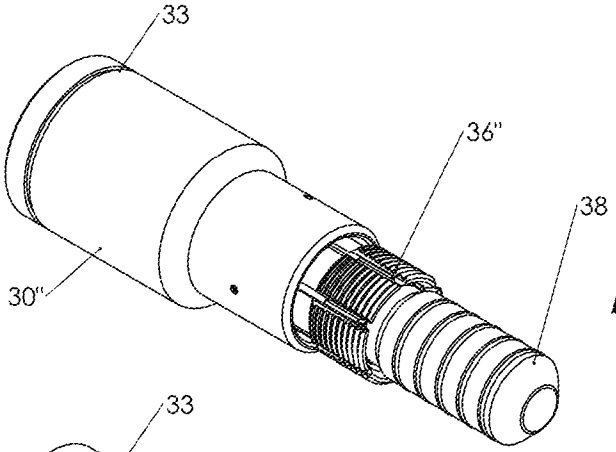
FIG. 6*c* illustrates a perspective view of a sealing dart having a ratcheting latch features for latching engagement with complementary features defined within the dart receptacle.
Figure 6B:
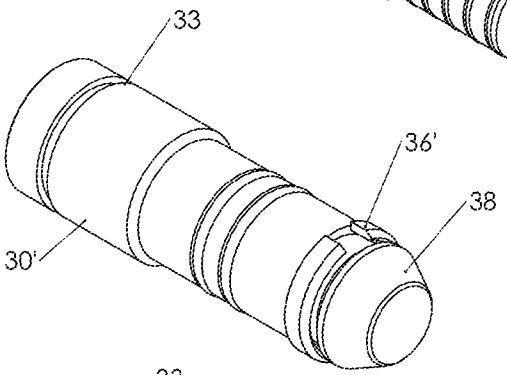
FIG. 6*b* illustrates a perspective view of a sealing dart having a split-ring latch for latching engagement with a complementary feature defined within the dart receptacle.
Figure 6A:
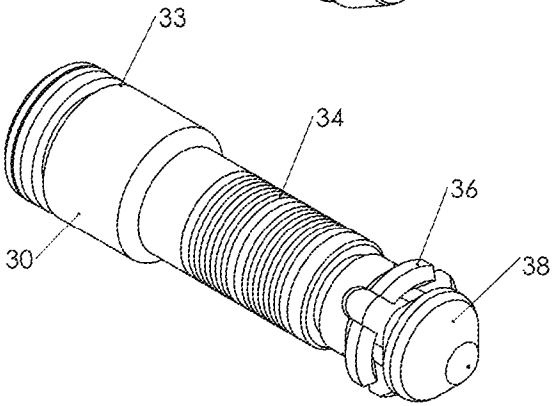
FIG. 6*a* illustrates a perspective view of a sealing dart having a segmented compression ring latch for latching engagement with complementary features defined within the dart receptacle.

With reference to FIG. 6*a*, one embodiment of the sealing dart includes a segmented compression ring latch 36 for latching engagement with complementary features defined within dart receptacle 40. Compression ring latch 36 is compressed inwardly as it passes through constrictions defined by receptacle 40 and expands outwardly upon the sealing dart landing with compression ring latch 36 aligned with a recess or other contour defined within receptacle 40. As described with reference to FIG. 5*a*, compression ring latch 36 can be spring loaded and cammed into a more secure engagement with the latching features formed within receptacle 40.

With reference to FIG. 6*b*, one embodiment of sealing dart 30' includes a split-ring latch 36' for latching engagement with a complementary feature defined within dart receptacle 40. Split-ring latch 36' is compressed inwardly as it passes through constrictions defined within receptacle 40 and expands outwardly upon the sealing dart landing with split-ring latch 36' aligned with a recess or other contour defined within receptacle 40. One or more O-ring seals contact the interior sidewalls of receptacle 40 to provide an axial seal.

With reference to FIG. 6*c*, one embodiment of sealing dart 30" is depicted including ratcheting latch features 36" for engaging with complementary features defined within dart receptacle 40. Such ratcheting features 36" can provide for incremental seating of sealing dart 30" within receptacle 40 as pressure is increased.

With continued reference now to FIGS. 6*a-c*, the sealing darts defines shear features for selective release of the dart upon application of sufficient differential pressure. In the depicted embodiments, a shear-ring groove 33 defined about the body of the sealing dart accommodates a shear ring. The shear ring further engages shear features defined within a corresponding plug bore. V-packing 34 provides for bidirectional axial sealing between the receptacle bore and the sealing dart to hold pressure applied from above and below the dart. Two different directional orientations of V-packing provide for bi-directional sealing.

Accordingly, the present invention provides a plug and dart system for wellbore cementing processes with the advantage of maintaining differential top pressures directly across the float equipment rather than solely across the bottom plug. The system further provides sealing backup to the float valve against bottom pressures. Various alternative embodiments may include other combinations of seals across both the float equipment and plugs. Similarly, while the present invention has been described herein as a plug and dart fluid barrier and sealing system for wellbore cementing processes, the present invention may be readily used with any number of other similar processes and related devices now known or hereafter developed.

Finally, while the present invention has been described above with reference to various exemplary embodiments, many changes, combinations and modifications may be made to the exemplary embodiments without departing from the scope of the present invention. For example, the various components may be implemented in alternative ways. These alternatives can be suitably selected depending upon the particular application or in consideration of any number of factors associated with the operation of the device. In addition, the techniques described herein may be extended or modified for use with other types of devices. These and other changes or modifications are intended to be included within the scope of the present invention.

What is claimed is:

1. A method of sealing a wellbore comprising:

deploying a bottom plug down a wellbore;

landing the bottom plug on float equipment within the wellbore;

deploying a top plug retaining via a shear ring a deployable dart down the wellbore;

landing the top plug atop the bottom plug; and deploying the dart from the top plug, at least partially through the bottom dart and into sealing contact with the float equipment;

further comprising forming an axial seal between the dart and the bottom plug.

2. A method of sealing a wellbore comprising:

deploying a bottom plug down a wellbore;

landing the bottom plug on float equipment within the wellbore;

deploying a top plug retaining via a shear ring a deployable dart down the wellbore;

landing the top plug atop the bottom plug;

deploying the dart from the top plug, at least partially through the bottom dart and into sealing contact with the float equipment; and forming an axial seal between the dart and the bottom plug;

wherein pressurization of the wellbore is at least partially maintained by a seal between the dart and the bottom plug.

3. A wellbore sealing system comprising:

a bottom plug defining a bore therein;

a top plug defining a bore therein; and a dart retained in the top plug via a shear ring, and being deployable through the bore defined in the top plug and the bore defined in the bottom plug to sealingly engage float equipment abutting the bottom plug;

wherein the dart further comprises a latch configured to engage a complementary feature of the float equipment;

wherein the dart is configured with first and second sealing surfaces to engage a complementary feature of the float equipment to provide bi-directional sealing;

wherein at least one of the sealing surfaces is a cammed surface that engages a complementary feature of the float equipment to provide bi-directional sealing.

4. A method of sealing a wellbore comprising:

deploying a bottom plug down a wellbore;

landing the bottom plug on float equipment within the wellbore;

deploying a top plug retaining via a shear ring a deployable dart down the wellbore;

landing the top plug atop the bottom plug; and deploying the dart from the top plug, at least partially through the bottom dart and into sealing contact with the float equipment;

further comprising receiving the dart within a receptacle defined in the float equipment;

wherein receiving the dart comprises latching the dart within the receptacle defined in the float equipment;

wherein latching the dart comprises compressing circumferential latch segments to pass a restriction defined in the receptacle and expanding the circumferential latch segments to engage a feature of the receptacle;

wherein the circumferential latch segments consist of cammed surfaces to engage a complementary feature of the receptacle.

* * * * *